US005335642A

United States Patent [19]

Hancock et al.

[11] Patent Number: 5,335,642

[45] Date of Patent: Aug. 9, 1994

[54] IGNITION COIL

[75] Inventors: Robert L. Hancock, Ann Arbor; Steven E. Pritz, Westland; Robert C. Bauman, Flat Rock; Shawn J. Nowlan, Ypsilanti, all of Mich.

[73] Assignee: Ford Motor Company, Dearborn, Mich.

[21] Appl. No.: 80,146

[22] Filed: Jun. 23, 1993

Related U.S. Application Data

[63] Continuation-in-part of Ser. No. 939,800, Sep. 3, 1992, Pat. No. 5,241,941.

[51] Int. Cl.[5] ..... F02P 11/00

[52] U.S. Cl. ..... 123/634; 336/110

[58] Field of Search ..... 123/634, 647, 635, 633, 123/169 PA; 336/110, 84 M, 155

[56] References Cited

U.S. PATENT DOCUMENTS

| | | | |
|---|---|---|---|
| 3,209,295 | 9/1965 | Baermann | 336/155 |
| 3,935,852 | 2/1976 | Donovan et al. | 123/148 A |
| 4,546,753 | 10/1985 | Pierret | 123/643 |
| 4,763,094 | 8/1988 | Kojima | 336/92 |
| 4,834,056 | 5/1989 | Kawai | 123/634 |
| 4,841,944 | 6/1989 | Maeda et al. | 123/647 |
| 4,893,105 | 1/1990 | Maeda et al. | 336/84 M |
| 4,903,674 | 2/1990 | Bassett et al. | 123/634 |
| 4,918,419 | 4/1990 | Ida | 336/192 |
| 4,990,881 | 2/1991 | Ooyabu | 336/110 |
| 5,036,827 | 8/1991 | Shimada et al. | 123/634 |
| 5,038,745 | 8/1991 | Krappel et al. | 123/634 |
| 5,101,803 | 4/1992 | Nakamura et al. | 123/634 |
| 5,144,935 | 9/1992 | Taruya et al. | 123/633 |
| 5,146,906 | 9/1992 | Agatsuma | 123/634 |
| 5,170,767 | 12/1992 | Wada et al. | 123/633 |
| 5,170,768 | 12/1992 | Eileraas | 123/634 |
| 5,186,154 | 2/1993 | Takaishi et al. | 123/634 |
| 5,191,872 | 3/1993 | Takaishi | 123/647 |

*Primary Examiner*—Raymond A. Nelli

*Attorney, Agent, or Firm*—Roger L. May; Richard D. Dixon

[57] ABSTRACT

An ignition coil having primary and secondary coils, the primary coil wound around a central core member and including a permanent magnet made of a magnetic material that is less than fully dense, and is interposed between one end of the central core member and one end of an outer core surrounding the primary and secondary coil assembly and assuring the elimination of any air gap between the iron core and the central core member. The ignition coil further having a common modular design for a slip-in fit into differing modular housing designs depending upon the number of cylinders in the engine.

15 Claims, 7 Drawing Sheets

IGNITION COIL

CROSS-REFERENCE TO RELATED APPLICATION

This application is a continuation-in-part of co-pending U.S. patent application Ser. No. 939,800, filed Sep. 3, 1992 now U.S. Pat. No. 5,241,941.

TECHNICAL FIELD

This invention relates to ignition coils, particularly modularly constructed ignition coils for vehicular ignition systems.

BACKGROUND OF INVENTION

In use in popular ignition systems for internal combustion engines is an ignition coil or coils having an iron core, i.e. ferro-magnetic, within a non-conductive housing, with the primary and secondary windings wound on individual bobbins inter-nested within one another and lying within the boundaries of the iron core, and with a portion of the core, i.e. an elongated leg, extending through the inner most bobbin along its axis. The coil is filled with epoxy potting material or other insulating material as a final step in the process. It is known that the efficiency can be increased and compactness of the overall coil structure, including the housing, can be reduced by providing a permanent magnet between the core portion surrounded by the coil windings and the remainder of the core, as well as also providing an air gap between the permanent magnet and the outer part iron core, i.e. that part of the core forming the outer closed magnetic circuit.

Such a coil construction is shown in U.S. Pat. No. 4,990,881. Part of the success in making such a coil design commercially practical has been the discovery of a very strong permanent magnetic material containing such elements as samarium (Sm), neodymium (Nd), and other similar rare earth, high energy materials. The permanent magnet used is made entirely of such material and referred to as "fully dense". The air gap of the iron core of the ignition coil, although reduced by insertion of the magnet, is still retained in the design of the aforementioned coil.

In contrast, in the subject invention a permanent magnet-type ignition coil is provided having preferably no air gap and also assuring that should there be a small air gap due to component tolerance stack-up it will be in a predetermined location thereby enhancing considerably the efficiency and power output of the coil. This allows for a substantial reduction in the size of the overall unit for acquiring the same unit power output. A further feature of the subject invention is the design and use of a permanent magnet composed of a bonded magnetic material, which is less than fully dense, made of these most recently available rare earth, high energy materials such as samarium and neodymium, thereby providing a material which is equally effective, but far less expensive than the fully dense permanent magnet heretofore used, and having the added benefit that its thickness, including the magnetizing alloy elements Nd or Sm or equivalent, provides for less expensive fabrication and easier handling during assembly of the coil.

Also in use are in ignition systems employing a wasted spark configuration, which have twin coil towers at opposite ends of the same coil assembly. A single ignition tower is provided for each spark plug in the engine. Thus a two cylinder engine has a single coil assembly, and a four cylinder engine has two coil assemblies, etc. For such systems, the coil assembly may be entirely different structures, i.e. the housings and connectors may be entirely different for one operation as opposed to another. Thus, each may require unique tooling or manufacturing techniques, thereby greatly increasing tooling and manufacturing complexity and costs. Another alternative is modular design and construction, accomplished by having pairs of coil connected to a coil, inserted within a housing having connectors on the housing that allow multiple housings to be connected in series. However, having this chain of coil housings connected together is not an efficient use of space.

SUMMARY OF INVENTION

The subject invention therefore contemplates an improved permanent magnet-type electromagnetic coil of the lightest weight and smallest size for its performance.

The invention further contemplates an electromagnetic ignition coil of the type described utilizing a rare earth, high energy magnetic material for the permanent magnet which is substantially less than fully dense, and therefore is less expensive than a magnet made of fully dense material and also completely eliminates the need for any air gap between the permanent magnet and the iron core, which in turn results in the maximum efficiency of the permanent magnet-type coil design.

The invention further contemplates an ignition coil of the type described above wherein the permanent magnet member includes means for virtually eliminating the air gap throughout the complete range of dimensional tolerances on each of the coil components contributing to the existence or nonexistence of the air gap.

The invention further contemplates an ignition coil assembly of modular construction and wherein the construction of the components provides means for insulating the iron core thermally from the epoxy filler material, such that the possibility of thermal stress cracks between the core and the primary and/or secondary windings are eliminated, and wherein the terminals leading to and from the primary and secondary coils require no soldering, and wherein the retainer bushings which are injection-molded into the coil housing include means for precluding the relative displacement of the bushing with respect to the housing in both the radial and axial directions.

The invention still further contemplates an ignition coil of a modular design having a common coil assembly for various numbers of pairs of spark plugs in a coil pack, with only the housing being unique for each number of spark plugs.

The invention additionally contemplates an ignition coil of a modular design in which the connectors and leads are molded into the housing with no solder required for the primary connection, thus allowing for a slip-in fit of the coil assemblies into a housing.

These and other features, objects and advantages, of the present invention are readily apparent from the following detailed description of the best mode for carrying out the invention when taken in connection with the accompanying drawings.

BEST MODE FOR CARRYING OUT THE INVENTION

Figure 1:
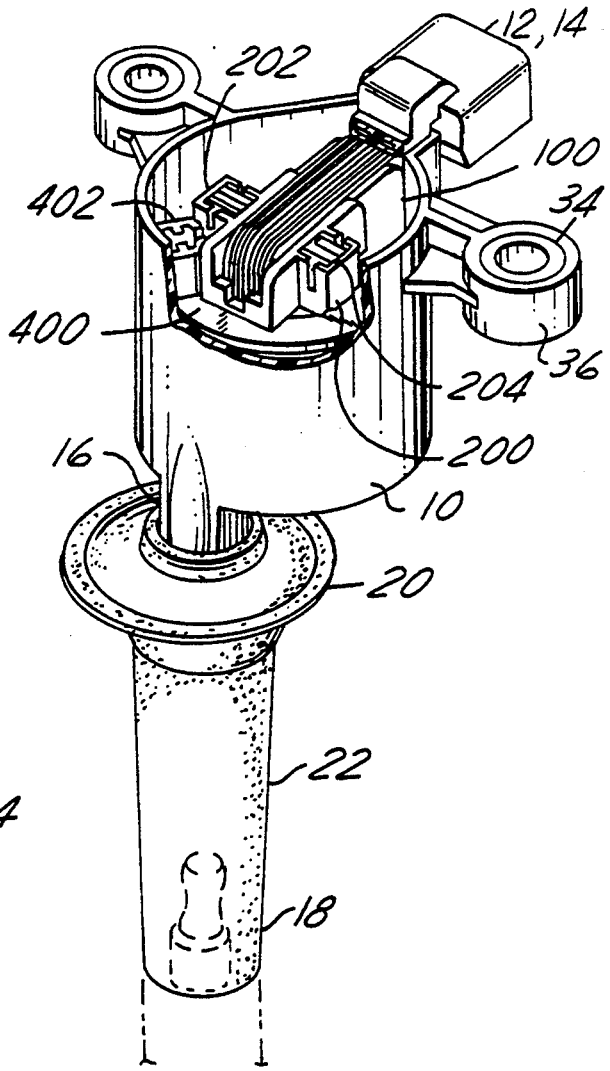
FIG. 1 is a general perspective view of the ignition coil assembly in accordance with the present invention and with potting material removed and the primary connector assembly in partial section.
Figure 5:
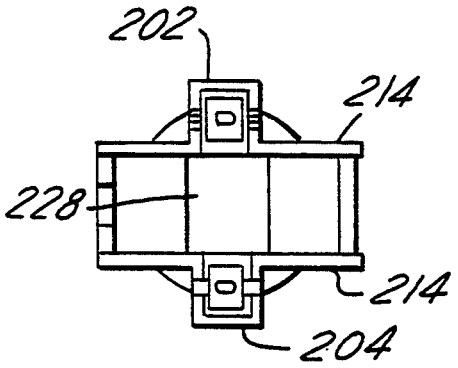
FIG. 5 is a plan view of the primary bobbin and winding assembly seen from the upper end thereof.
Figure 3:
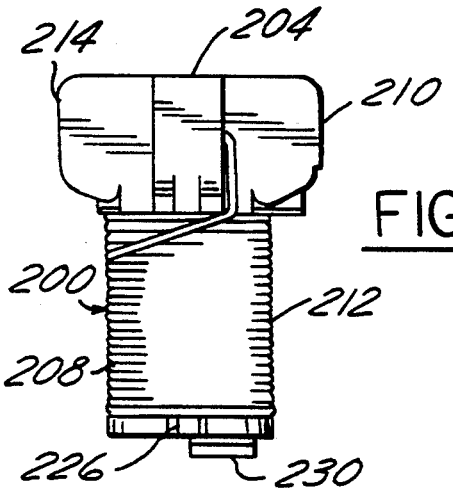
FIG. 3 is an elevation view of the primary winding and bobbin assembly in accordance with the present invention.

In FIG. 1 is shown the overall assembly of the first embodiment of the ignition coil assembly of the present invention. The ignition coil is a coil-per-plug type ignition coil assembly mounted upon and electrically connected to a typical ignition spark plug as shown in phantom. It will be noted that the ignition coil assembly is extremely compact. It includes a generally annular housing 10 within which is nested a steel laminated C-shaped core member 100 which provides an open cavity portion or air gap between its terminal ends, and with a primary and secondary bobbin assembly 200, 400 residing within the cavity portion between the terminal ends of the C-shaped core member 100. The primary coil member 200 includes a T-shaped steel laminated core member (not shown) extending axially through the primary bobbin.

The primary bobbin includes a pair of primary terminal receptacles 202, 204 within which are located solderless, spring-retained, insulation displacement terminals.

A primary connector assembly 12, partially shown, is adapted to clip onto the housing and includes leads in a receptacle portion 14 which establishes electrical connection across the primary and secondary coils in a manner to be described below.

The secondary bobbin 400 includes an input terminal 402 and a corresponding secondary bobbin output terminal (not shown in FIG. 1) which is located at the lower end of the secondary bobbin within the area of the terminal stem portion 16 of the housing. Slip-fit over the terminal stem portion 16 is a flexible rubber boot 18 having a collar 20 which grips the stem portion 16 and a barrel portion 22 adapted to grip and establish electrical connection with a spark plug head in a manner described below.

Figure 2:
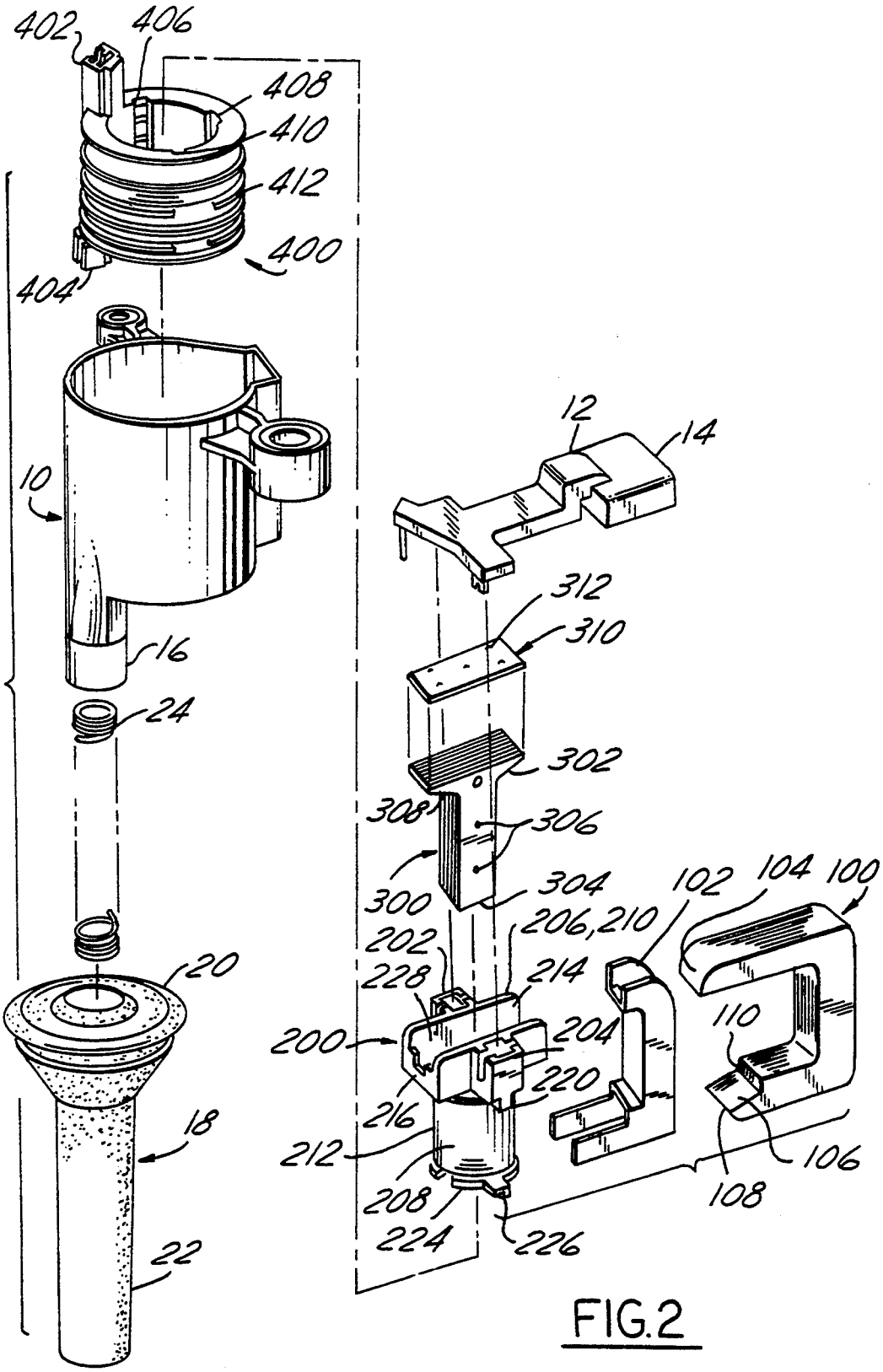
FIG. 2 is a perspective, exploded view of the ignition coil assembly shown in FIG. 1.

FIG. 2 further illustrates the unique compactness of the ignition coil assembly, and the manner in which it is assembled in unique modular assembly form. For example, the primary bobbin subassembly 200 includes a primary bobbin 206 having a primary coil 208 wound around the longitudinal axis thereof. The bobbin 206 includes an upper channel-shaped head portion 210 and a lower annular portion 212. The bobbin includes a rectangularly shaped bore 228 extending along the longitudinal axis thereof from one end to the other and sized to receive, in sliding fit, the T-shaped steel laminated core member 300. The upper channel section of the bobbin includes a pair of spaced side walls 214 and a stop wall 216 at one end thereof, extending between the side walls. The upper channel section includes three locating lugs 218, 220, 222, (218 and 222 not shown in this view). Two of these (218, 220) are located at the bottom of the respective terminal receptacles 202, 204. At the bottom of the primary bobbin is located an annular collar 224 and radially projecting from the collar is a pair of similar locating lugs 226 axially aligned with those extending from the terminal portions 202, 204 of the upper portion of the bobbin.

The T-shaped core member 300 which is slidingly received within the primary bobbin assembly 200 includes a cross-bar member 308 having tapered under sides 302 at one end and a tapered end or ramp 304 at its other end. The T-shaped core member is a series of steel laminations secured together by punched or stamped stakes 306.

Magnetically attached to the cross-bar portion 308 is a plate-like permanent magnet 310. It includes a plurality of protrusions 312 on its upper surface. The height or length of each equally or slightly exceeding the maximum differential in stack-up tolerances governing the filling of the distance between the terminal ends of the C-shaped core member by the T-shaped core member and permanent magnet. The magnet member is made of a bonded magnetic material which is substantially less than fully dense. It is made of grains of rare earth, high energy materials such as neodymium and samarium evenly dispersed within a binder, such as a plastic or epoxy matrix. In our preferred example, neodymium grains are dispersed within a nylon matrix such that the resulting composite material has a flux density of 4.2 kilogauss, whereas a fully dense magnet would have a flux density of 12 kilogauss.

The primary coil bobbin assembly 200 is adapted to be received within the annular secondary coil bobbin assembly 400. The secondary coil bobbin assembly includes integral secondary terminal portions 402 and 404. Within the end of each terminal portion is located a similar solderless spring-retained insulation terminal. Located about the inner cylindrical surface of the secondary terminal are three longitudinally extending slots 406, 408, 410, each being open to the coil winding 412 which is wound about the outer periphery of the secondary coil bobbin member 400 and connected about its respective ends to input and output secondary terminal portions 402, 404. The width of the slots 406, 408, 410 matches that of the locating lugs 218, 220, 222 respectively of the primary bobbin assembly. Thus, when the primary bobbin is inserted within the secondary bobbin, it is uniquely located within the secondary bobbin by keying the circumferential location of each locating lug. Also, the relative longitudinal location is fixed by virtue of the tapered undersides of the upper channel portion of the bobbin coming to rest on the edge or lip of the secondary bobbin. Further, the slots 406, 410 on the secondary bobbin have tabs 418 on the underside of the bobbin. As the upper channel portion of the primary bobbin comes to rest on the lip of the secondary bobbin, the protrusions 232 on the locating lugs 226 engage the tabs 418, thus snapping the primary bobbin in place.

Next, the plastic terminal insulating clip member 102, made of modified polypropylene with 10% filler, or other suitable material, is slid within the open cavity of the C-shaped core member 100. The clip is sized such that the side walls thereof firmly grip the outer walls of the C-shaped core member, as shown and described below.

Next, the C-shaped core member 100 with clip 102, is inserted from its open end within the channel-shaped upper head portion of the primary bobbin such that the upper terminal end 104 of the C-shaped core member will come to rest against the stop wall 216 of the primary bobbin. At the same time, the ramp or inclined end portion 304 of the T-shaped core member within the primary bobbin assembly will engage in line-to-line contact along the corresponding ramp end portion 106 of the C-shaped core member at its other terminal end 108. The assembly continues until the T-shaped core member abuts the stop shoulder 110 of the C-shaped core member. Further, the degree of lift designed into the inclined ramp, is also designed to force the T-shaped core member 300 and permanent magnet 310 into full contact with the other terminal end portion of the C-shaped core member 100, thus virtually eliminating any air gap which might otherwise exist between the C-shaped core member and the T-shaped core member.

By virtue of the protrusions 312 extending from the permanent magnet, some degree of physical contact between the permanent magnet and T-shaped core member on the one hand and the end 104 of the C-shaped core member is always guaranteed. This in turn assures that there will always exist at the other end line contact across the interengaging ramp surfaces 304, 106 of the core members 300, 100, respectively.

Next, the core and primary and secondary bobbin sub-assembly is slid within the housing 10. Thereafter, the boot assembly including the retainer spring 24 is slip-fit onto the one end of the housing and the primary connector assembly 12 is clipped onto the opposite end of the housing. This completes the core assembly, as shown in FIGS. 1 and 2.

Figure 4:
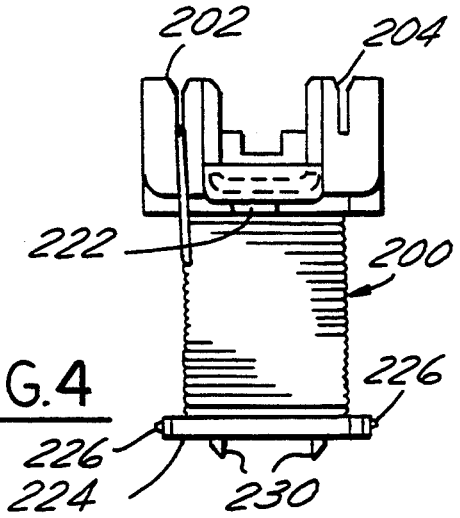
FIG. 4 is a view similar to FIG. 3 and rotated 90° to show further detail of the primary bobbin and winding assembly in accordance with the present invention.
Figure 6:
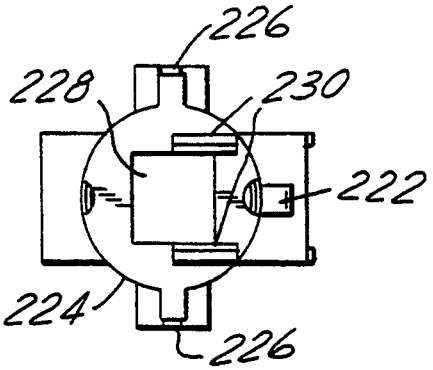
FIG. 6 is a plan view of the primary bobbin and winding assembly shown in FIGS. 3 and 4, as viewed from the bottom end thereof.

In FIGS. 3–6 are shown the details of the primary coil bobbin. The primary coil bobbin 200 is a conventional injection molded member made of nylon, or other suitable material, and includes a channel-shaped head portion 210 and lower annular reel portion 212 upon which is spirally wound a primary coil 208. Through the center of the bobbin is a rectangular cross-sectioned bore 228 for receiving the T-shaped core member in sliding fit engagement. Upper locating lug 222 is shown in FIG. 4 as well as the lower locating lugs 226 as shown in FIG. 6, which are located longitudinally opposite the respective upper locating lugs 218, 220. Further, it will be noted that extending within the same transverse direction as the channel-shaped upper member, is a pair of guide rails 230 located on the bottom collar 224. The guide rails 230 extend transversely over the portion of the rectangular bore 228 and are spaced from one another a distance slightly greater than the width of the C-shaped core member. The guide rails 230 serve to receive the lower terminal portion 108 of the C-shaped core member 100 as it is being slipped into engagement with the primary and secondary bobbin assemblies.

Thus, the primary bobbin assembly is uniquely constructed such that the relative position of the bobbin member with the C-shaped core on the one hand and the secondary bobbin assembly on the other, can only be accomplished in one particular orientation. Misassembly is thereby eliminated.

Figure 10:
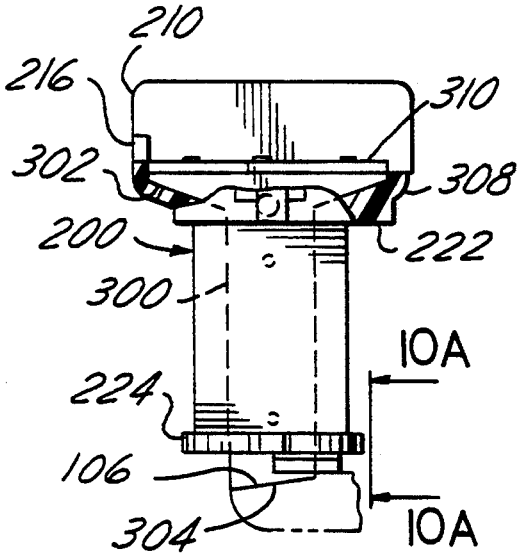
FIGS. 10 and 10A are an elevation view, shown partially in section, of the primary bobbin and winding assembly in combination with the T-bar steel laminated core in accordance with the present invention.

Looking at FIG. 10, for example, it will be noted that the T-shaped core member is oriented such that the cross-bar member is received within the channel member 210, and that the head of the cross-bar member 308 comes to rest with the tapered side walls 302 in such a manner that the top of the head is just below the stop wall 216, and that the ramp 304 at the other end of the T-bar member 300 is inclined in a manner to correspondingly receive the ramp portion 106 of the C-shaped core and is fitted within the lower guide rails 230. It will also be noted from FIG. 10 that the plate-like permanent magnet member 310, being of the same width and length as the top of the cross-bar member can be slid into place from the open side of the channel members whereupon it will come to rest at the stop wall 216. While it is preferred that the protrusions 312 on the permanent magnet be located so as to engage the C-shaped core member, the coil assembly would work equally well if the protrusions were facing the cross-bar member. Forming the protrusions on the interengaging surface of the core member 300 is also an alternative.

Figure 8:
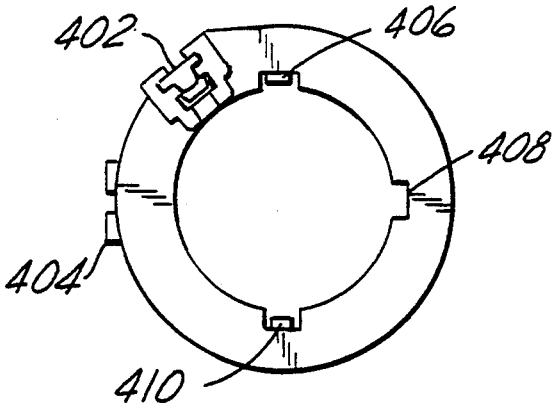
FIG. 8 is a plan view of the secondary bobbin and winding assembly shown in FIG. 7 as viewed from the upper end thereof.
Figure 7:
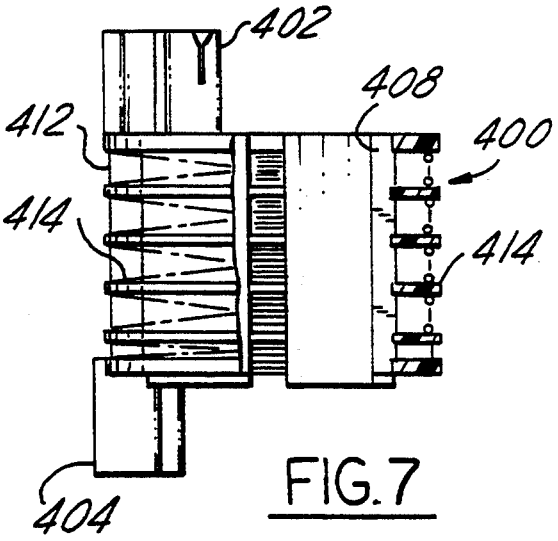
FIG. 7 is an elevation view of the secondary bobbin and winding assembly in accordance with the present invention.
Figure 10A:
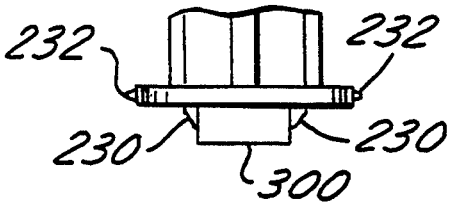
Figure 9:
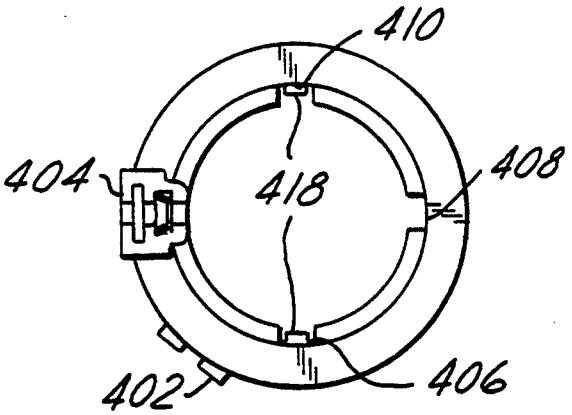
FIG. 9 is a plan view of the secondary bobbin and winding assembly shown in FIG. 7 as viewed from the bottom thereof.
Figure 11:
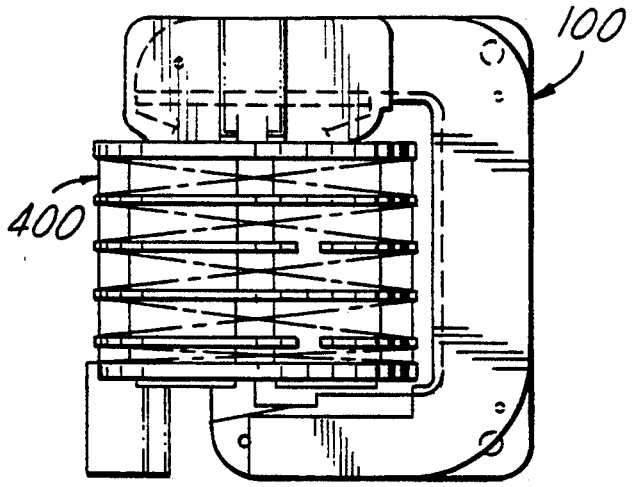
FIG. 11 is an elevation view of the primary and secondary bobbin and winding assemblies in combination with the laminated core assembly components in accordance with the present invention.

Looking at FIGS. 7–9, there is shown the details of the secondary bobbin 400 and winding assembly. Like the primary coil bobbin, the secondary coil bobbin is an integral injection molded plastic member, preferably made of nylon or similar material. It is generally cylindrical, with the inner diameter being sized to closely receive the primary bobbin assembly and including a plurality of elongated slots 406, 408, 410 extending completely through the side wall of the bobbin. The input and output terminal portions 402, 404 are located at respective ends of the bobbin. The bobbin includes a plurality of annular ribs 414 for maintaining the location of the coil as it is wound annularly over the bobbin. The slots 406, 408, 410 are adapted to receive the locating lugs 218, 220, 222 respectively of the primary bobbin assembly as earlier explained. Further, after assembly of all components, when the ignition coil assembly is to be filled with the potting material pursuant to conventional practice, the potting material will flow within the elongated slots on the inner portion of the secondary bobbin assembly and radially through to all inner portions of the secondary winding, thus enhancing the efficient filling of the coil assembly and eliminating all voids within the components.

Figure 12:
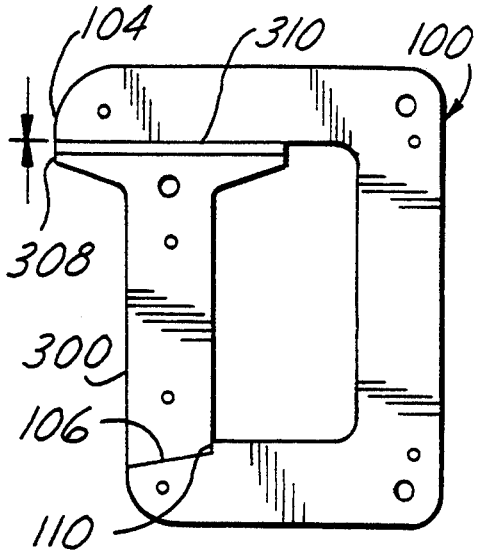
FIG. 12 is an elevation view showing only the assembly of the steel laminated C-shaped core, and T-shaped core, in combination with the permanent magnet in accordance with the present invention.

In FIG. 12 there is shown just the assembly of the steel laminated core members 100, 300 and the permanent magnet 310. It will be noted that the C-shaped core member 100 includes at one end portion a ramp 106 which terminates at a stop shoulder 110. The width of the ramp is designed to match that of the T-shaped cross-member so that upon assembly the core members will be flush at the outer periphery.

Also from FIG. 12, it is noted that no air gaps exist between the permanent magnet 310 and the other terminal end portion 104 of the C-shaped core member. This is the ideal design condition in accordance with the present invention. However, due to normal component tolerances stack up, it would not be abnormal to find during production that an extremely minor air gap does exist between the permanent magnet 310 and the C-shaped coil member for a limited number of coil assemblies. To eliminate even this possibility, the permanent magnet is provided with a number of protrusions 312 which extend outwardly from the permanent magnet a distance equal to or slightly exceeding the maximum differential in stack up of dimensional tolerances of the components, i.e. the collective maximum difference between the minimum and maximum tolerances on each component. When the core members are assembled with the minimum stack-up tolerance differential, the protrusions will be completely flattened over the surface of the permanent magnet under the force of the T-bar member 300 being forced along the ramp portion 106. On the other hand, when the maximum tolerance differential exists thereby allowing what would otherwise be an air gap between the core members 100, 300, the protrusions 312 of the permanent magnet 310 will still come into contact with the C-shaped coil member and the air gap will be virtually eliminated or the air gap will be present only in the area of the greatest cross-sectional area of the T-bar core member 300, which is the cross-bar portion 308.

Figure 13:
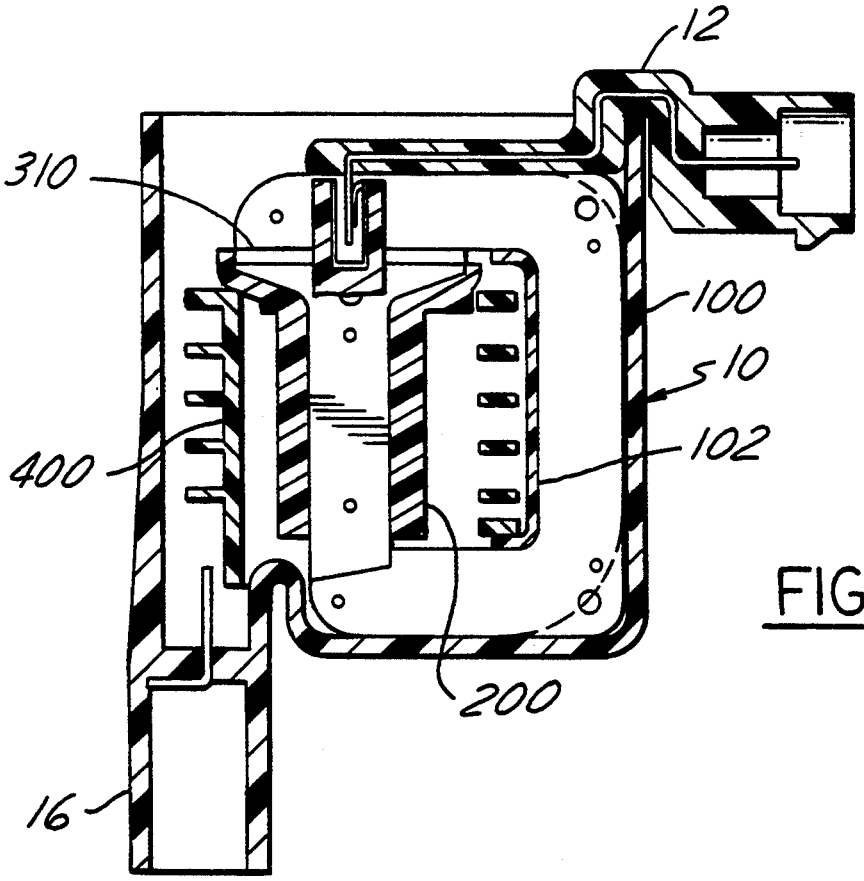
FIG. 13 is an elevation view, shown in section, of the entire ignition coil assembly in accordance with the present invention, but excluding any showing of the lower boot member.

FIG. 13 shows a cross-section of the ignition coil assembly previously described. It will be noted that no air gap exists between the permanent magnet 310 and either core members 100, 300. It will be noticed that the primary coil bobbin member 200 is precisely and compactly located within the annular secondary coil bobbin member 400 and that the primary and secondary bobbin assemblies are closely nestled within the open portion of the C-shaped member 100. Further, it will be noted how the thermal insulating clip 102 insulates the secondary winding assembly precluding the possibility of thermal stress generated by the heat and resultant expansion of the C-shaped core member from causing any stress cracking which might otherwise cause a short circuit between the C-shaped core member and the secondary winding.

Figure 14:
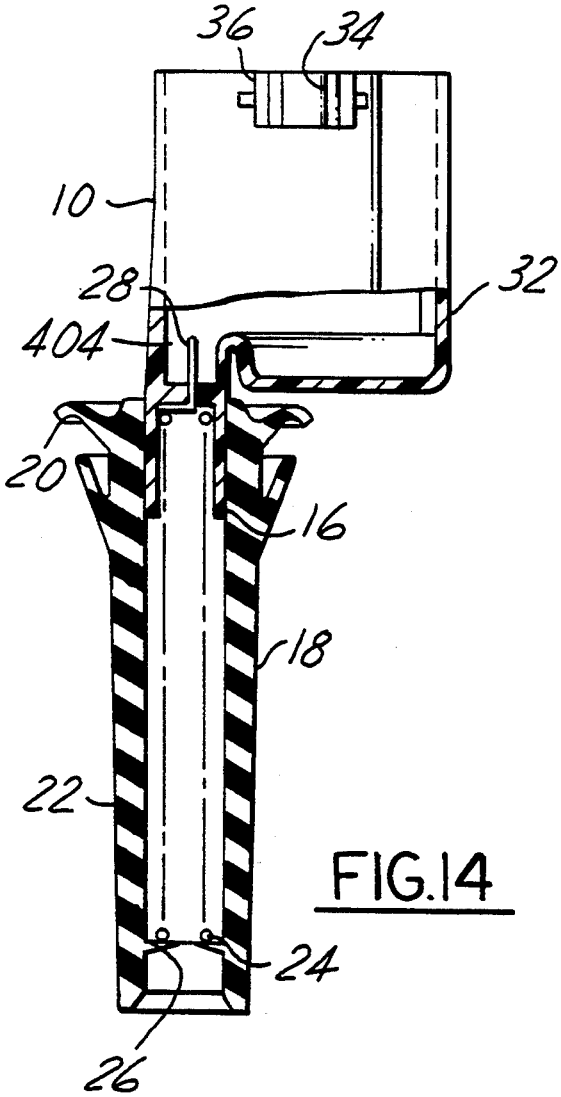
FIGS. 14 and 14A are an elevation view shown partially in section of the housing, less the inner iron core and bobbin assemblies, and in combination with the lower boot member, in accordance with the present invention.
Figure 14A:
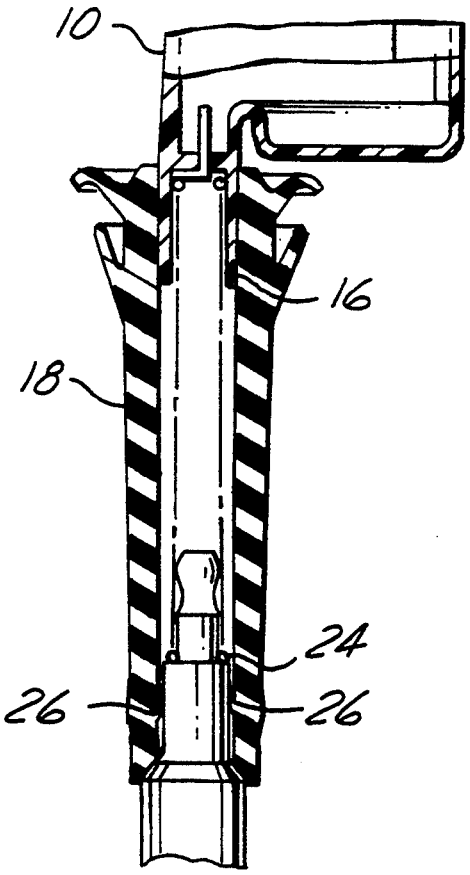

FIG. 14 illustrates another important feature of the subject invention, mainly the manner in which the rubber boot member 18 is adapted to be slip-fit onto the housing portion 16 and to loosely retain the retainer spring 24 by virtue of its being completely open at one end and concluding at its other end at an annular integral rubber inwardly directed lip 26 which acts as a spring arrest. Thus, the retaining spring may be slipped into the boot from the end opposite the spring arrest lip 26. The spring is loose fit within the housing terminal portion 16 and of a sufficient non-compressed length to come into loose contact with the half-moon shaped base 28 of the secondary coil output terminal 404. Thereafter, when the spark plug is inserted at the opposite end of the boot 18, the spring 24 will be forced into electrical contact between the secondary coil output at one end and the spark plug head at the other end. The arrest lip 26 is constructed with sufficient radial dimension such that the spring will be retained within the boot when the spark plug is detached from the boot assembly.

Also shown at the lower portion of the annular housing member 10 is a molded-in-place core receiving well having a pair of oppositely disposed side walls 32, one of which is shown, spaced from one another sufficiently to closely receive the lower portion of the C-shaped core member 100 and retain the coil member in fixed position relative to the housing.

Figure 15:
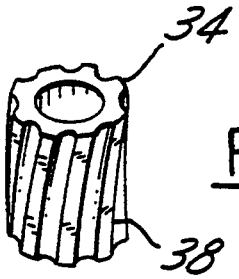
FIG. 15 is a perspective view of the housing mounting member boss bushing which is injection molded into the housing mounting member arm and boss assembly in accordance with the present invention.

FIGS. 14 and 15 show a uniquely constructed powdered metal sintered bushing 34 to be injection molded into the housing mounting member 36. The bushing includes a plurality of helical retention ribs 38 spaced about the circumference of the bushing. Any tendency of the bushing 34 to turn in the housing is thereby precluded as well as any tendencies toward axial displacement.

Figure 16:
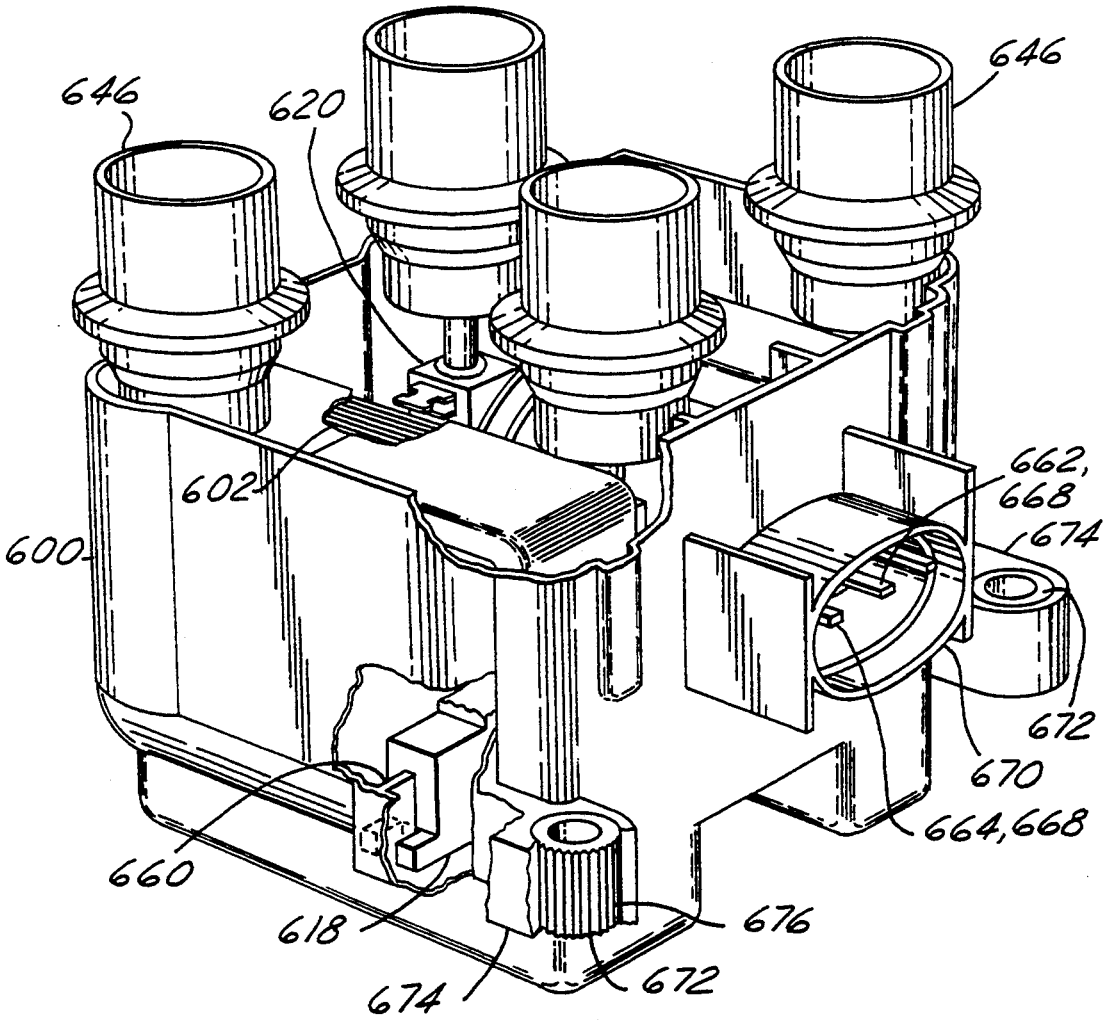
FIG. 16 is a perspective view of a four tower modular ignition coil assembly in accordance with the present invention and with potting material removed.
Figure 17:
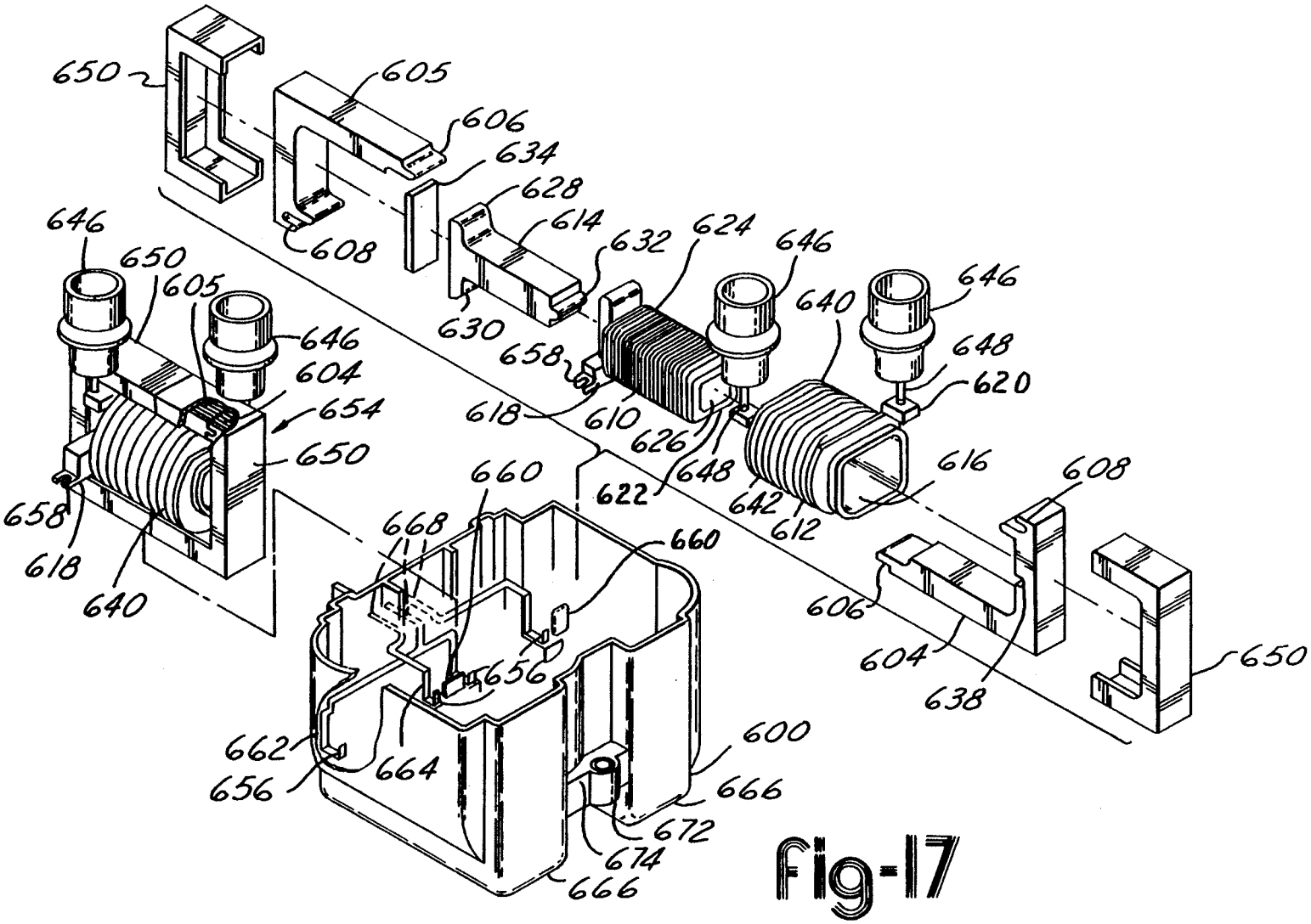
FIG. 17 is a perspective, partially exploded view of a four tower modular ignition coil in accordance with the present invention.

An alternative embodiment is shown in FIGS. 16 and 17. FIG. 16 shows the overall assembly of the ignition coil apparatus for a four cylinder engine (not shown). This ignition coil is a wasted spark type ignition system. The wasted spark type of system has a pair of spark plugs (not shown) operating from each coil assembly. Thus, in a four cylinder engine, there are two coil assemblies each having two coil towers. This concept will also work equally as well for engines with different numbers of spark plugs. The modular design allows for a common coil assembly for each pair of spark plugs.

FIGS. 16 and 17 illustrate the unique modular assembly. The ignition coil apparatus includes a thin-walled plastic housing 600 within which nests a pair of steel laminated box-shaped outer cores 602. Each of the box-shaped cores 602 form an open cavity portion, and each is made up of a pair of laminated J-shaped core portions 604, 605 having corresponding interconnecting tongue 606 and groove 608 at their terminal ends. The box-shaped cores 602 each have a primary 610 and secondary 612 bobbin sub-assembly residing within their respective open cavities, with the primary bobbin sub-assembly 610 telescopically engaged within the bore 616 of the secondary bobbin sub-assembly 612. Within the primary bobbin sub-assembly 610 resides a steel laminated T-shaped inner core 614, extending axially therethrough. The T-shaped core 614 is preferably made of an M19 non-grain oriented steel.

The T-shaped core 614, which is slidingly received within the primary bobbin sub-assembly 610, includes a cross-bar member 628. The member 628 has tapered under sides 630 at one end and a tongue 632 at its other end which corresponds to a groove 638 on one side of the J-shaped core portion 604. Magnetically attached to the cross-bar portion 628 is a plate-like permanent magnet 634. The permanent magnet 634 is made of a less than fully dense material as in the first embodiment.

The primary bobbin sub-assembly 610 includes a pair of primary terminal receptacles 618 within which are solderless, spring retained, insulation displacement terminals. The primary bobbin sub-assembly 610 includes a primary bobbin 622 having a primary coil 624 wound around the longitudinal axis thereof. The primary bobbin 622 includes a generally rectangularly shaped bore 626 extending along the longitudinal axis thereof from one end to the other and sized to receive, in sliding fit, the T-shaped core member 614 with one end of the bore 626. The bore 626 is tapered at one end to enclose the tapered undersides 630 of the T-shaped core 614.

The primary bobbin sub-assembly 610 is adapted to be received within the secondary bobbin sub-assembly 612. The secondary bobbin sub-assembly 612 includes a pair of springless secondary output terminals 620. The secondary bobbin sub-assembly 612 includes a secondary bobbin 640 having a secondary coil 642 wound around the longitudinal axis thereof. The secondary output terminals 620 are oriented perpendicular to the longitudinal axis of the bobbin to allow for ease of winding the secondary coil 642 and connecting it to the secondary output terminals 620. The secondary bobbin 640 includes a generally rectangularly shaped bore 616 extending along the longitudinal axis thereof from one end to the other and sized to receive, in sliding fit, the primary bobbin assembly 610. Tabs and grooves or the like can be used to assure that the two bobbins are properly aligned relative to one another when assembled to avoid any possibility of misassembly.

Then, the T-shaped core 614 and bobbin assemblies 610, 612 are inserted in the outer core assembly with the tongue 632 of the T-shaped core portion 614 being inserted into the groove 638 of the first J-shaped core portion 604. Then, the second J-shaped core portion 605 is brought into position by inserting each tongue 606 into its corresponding groove 608 on the terminal ends of the J-shaped core portions 604, 605. Preferably, the tongue-and-groove joints formed here are interference fit to hold the entire assembly together. The interference fit is created when the tongue 606 is slightly larger than its corresponding groove 608. Bringing the two J-shaped portions 604, 605 together forces the end of the T-shaped core 614 and the permanent magnet 634 into full line contact with two opposed sides of the J-shaped core portions 604, 605. The tongues 606 and grooves 608 on the J-shaped core portions 604, 605 are sized to account for any stack up tolerances created during fabrication of the parts and will assure eliminating any air gap between opposing sides of the box-shaped core 602 and the T-shaped core 614 which might otherwise exist.

An alternate configuration may also be used to assure that any air gap is eliminated. In this configuration, tongue 632 and groove 638 have corresponding tapers. In light of the tongue 632 being tapered, one end thereof will have a greater height than the other. The groove 638 will be constructed the same such that as the T-shaped core 614 is slid into the assembled outer core 602, the air gap between the cross bar member 628 (and permanent magnet 634) and the core portion 605 will be eliminated, in similar fashion to the construction of FIG. 2. In this configuration, the J-shaped core portions 604, 605 are assembled before the T-shaped core 614 and bobbin assemblies 610, 612 are slid into the outer core 602, with the tapered tongue 632 being inserted into the tapered groove 638, to accomplish the removal of any air gap. In this alternate configuration, the permanent magnet may also have protrusions on one side of the permanent magnet as described in the first embodiment of the present invention.

The coil towers 646 are preferably installed using a poke pin design into the secondary output terminals 620, although they can be the screw-in type instead. The tower insert portions 648 of the coil towers 646 can then be made of less expensive zinc rather than aluminum since the ends do not need to be threaded for insertion into the secondary output terminals 620.

The plastic thermal insulating clip members 650, made of a modified polypropylene with 10% filler, or other suitable material, are slid about the sides of the box-shaped core 602. The clips 650 are sized such that the side walls thereof firmly grip the outer walls of the box-shaped core 602. The clips 650 reduce the possibility of cracks between the box-shaped core 602 and the epoxy filler, used to fill in the voids in the housing after the assembly is complete, during extreme thermal conditions.

Next, each coil assembly 654 is slid into the housing 600. For the embodiment shown, two such coil assemblies 654 are slid into the housing. Each coil assembly 654 is aligned such that the coil assembly 654 slides into receiving well portions 666, and the alignment slots 658 on the primary bobbin sub-assembly 610 slide onto their corresponding locating tabs 660 protruding from the housing 600. This sliding fit retains the sub-assembly 654 in a fixed position relative to the housing 600 and thereby aligns the primary terminal receptacles 618 with the terminal ends 656 of the negative 662 and positive leads 664. The primary terminal receptacles 618 then maintain electrical contact without the need to solder these connections together.

The negative lead 662 is fabricated from a flat sheet of electrically conductive material bent into the proper shape, and is molded into the housing 600. It has one terminal end 656, which connects to one primary terminal receptacle 618 of every coil assembly 654 to be contained within the housing. Each coil assembly 654 has its other primary terminal receptacle 618 connected to a separate positive lead 664. The positive leads 664 are also made of a conductive material and molded into the housing 600. The other terminal ends 668 of the leads 662, 664 protrude into the primary connector receptacle portion 670 of the housing 600 which is shaped to receive an electrical input plug (not shown).

Powdered metal sintered bushings 672 are molded into housing mounting members 674 similar to the first embodiment. In addition to helical retention ribs, the bushings 672 may also have axially aligned retention ribs 676 spaced about the circumference of the bushing, as shown in FIG. 16. In this instance, the bushings 672 are placed in a tumbler, prior to being molded into the housing mounting member 674, which causes nicks to be created on the surface of the bushing 672. These nicks preclude tendencies toward axial displacement of the bushings 672 within the housing mounting member 674, while the ribs preclude the tendency of the bushings 672 to rotate within the housing mounting member 674.

While the best mode for carrying out the invention has been described in detail, those familiar with the art to which this invention relates will recognize various alternative designs and embodiments for practicing the invention as defined by the following claims.

We claim:

1. A wasted spark ignition coil assembly comprising:

a box-shaped iron core member defining an air gap between two opposed portions of said box-shaped core;

a coil sub-assembly within said air gap comprising a primary coil member and a secondary coil member;

both said primary coil member and said secondary coil member comprising a bobbin, each of said bobbins having a longitudinal axis parallel with one another, and a plurality of windings of electromagnetic material being wound about said longitudinal axis of each said bobbin, said primary coil member received telescopically within said secondary coil member; and said primary coil member including a permanent magnet member disposed at one end of said bobbin and in intimate contact with said box-shaped core member at said two opposed portions and thereby completely filling said air gap, said permanent magnet member being made of a magnetic material dispersed within an electrically non-conductive matrix and being at substantially less than full density within said matrix.

2. The invention of claim 1 wherein said permanent magnet member is made of a powdered magnetic material having a flux density of about 4.2 kilogauss.

3. The invention of claim 1 wherein said permanent magnet member is made of a plurality of grains of magnetic material selected from the group consisting of neodymium and samarium and dispersed within a plastic matrix.

4. A wasted spark ignition coil assembly adapted for use with an internal combustion engine comprising:

a box-shaped iron core member defining an air gap between two opposed portions of the box-shaped member;

a coil sub-assembly within said air gap comprising a primary coil member and a secondary coil member;

both said primary coil member and said secondary coil member comprising a bobbin, each of said bobbins having a longitudinal axis parallel with one another, and a plurality of windings of electromagnetic material being wound about said longitudinal axis of each said bobbin, said primary coil member being received telescopically within said secondary coil member;

said primary coil member including a T-shaped iron core member slidingly disposed along the longitudinal axis of said bobbin and in line contact with a through-bore of said bobbin, said T-shaped core member including a pair of oppositely disposed ends, one said end residing at the base end of said T-shaped member and the other end comprising the cross-bar portion of said T-shaped member;

a permanent magnet member located at said cross-bar end of said T-shaped member, said permanent magnet member being made of a magnetic material dispersed within an electrically non-conductive matrix and being at substantially less than fully dense;

said permanent magnet member being in intimate contact with one of said two opposed portions of said box-shaped core member, and said T-shaped core member at its base end being in intimate full line contact with the other of said two opposed portions of said box-shaped core member; and at least one of said permanent magnet member and said box-shaped core member including means for eliminating completely any air gap between said other of said two opposed portions of said box-shaped core member and said base end of said T-shaped core member.

5. The invention of claim 4 wherein said base end of said T-shaped core member comprises an end surface having a tongue projecting therefrom, and the respective opposed portion of said box-shaped core member provided with a corresponding groove of the same size as said tongue and located generally midway along said opposed portion to thereby define a tongue-and-groove joint with said base end and said opposed portion in line contact with one another whereby upon assembly of the coil sub-assembly within the air gap of said box-shaped core member, common manufacturing stack-up tolerances in the respective components which are normally determinative of the extent of said air gap between the members can be eliminated and a zero air gap provided as the corresponding surfaces of said core members are juxtaposed relative to one another in a final assembled position; and said permanent magnet member including means for eliminating the effect of any tolerance in said air gap and assuring intimate line contact with said one of said two opposed portions of said box-shaped core member.

6. The invention of claim 5 wherein said box-shaped core comprises two J-shaped portions, with one of said J-shaped portions having one-half of a tongue-and-groove joint at each end thereof, the other of said J-shaped portions having a corresponding mating tongue-and-groove joint at each end thereof to thereby mate with said ends of said one J-shaped portion, with the relative sizes of said tongues greater than their corresponding grooves creating an interference fit joint.

7. The invention of claim 5 wherein said permanent magnet member is a flat magnetic plate.

8. A wasted spark ignition coil assembly adapted for use with an internal combustion engine comprising:

a housing of molded plastic material;

at least one coil subassembly within said housing and including a box-shaped electromagnetic core member defining an open cavity between two opposed portions of said box-shaped member, and a coil sub-assembly positioned within said open cavity;

said at least one coil subassembly comprising a primary coil member and a secondary coil member within said cavity, said primary coil member comprising a primary bobbin and said secondary coil member comprising a secondary bobbin, each of said bobbins having a longitudinal axis substantially parallel with one another and a plurality of windings of electromagnetic material wound about said longitudinal axis of each said bobbin, said primary bobbin further having a pair of primary terminal receptacles electrically connected to opposite ends of said winding on said primary bobbin and said secondary bobbin further having a pair of secondary terminals connected to opposite ends of said winding on said secondary bobbin;

a negative lead molded into said housing slidingly engaging one of said primary terminal receptacles of each of said at least one coil subassembly;

a positive lead molded into said housing for each of said at least one coil subassembly slidingly engaging the other of said primary terminal receptacles; and a pair of coil towers attached to said secondary coil member secondary terminals of each of said at least one coil subassembly.

9. The invention of claim 8 wherein said housing includes at least one mounting member fixed to said housing; an annular bushing injection molded into said housing mounting member; said bushing having a through-bore throughout the length of said bushing adapted to thereby receive a mounting bolt or similar member for securing said ignition coil to a support structure and said bushing further including a rib means protruding from the periphery thereof and embedded within said mounting member whereby said bushing is restrained from axial and rotational displacement in relation to said housing.

10. The invention of claim 9 wherein said bushing rib means includes a plurality of axially oriented retention ribs protruding from said bushing and spaced about the circumference of said bushing, said retention ribs having a plurality of randomly spaced nicks in their surface.

11. The invention of claim 8 wherein said pair of coil towers each comprises a conductive shaft portion for sliding insertion into said secondary terminals of said secondary coil.

12. The invention of claim 8 wherein said primary coil member includes a permanent magnet member disposed at one end of said bobbin and in intimate contact with said box-shaped core member at said two opposed portions and thereby completely filling said open cavity, said permanent magnet member being made of a magnetic material dispersed within an electrically non-conductive matrix and being at substantially less than full density within said matrix.

13. The invention of claim 8 wherein said secondary terminals are perpendicular to said longitudinal axis of said secondary bobbin.

14. The invention of claim 8 wherein said at least one coil subassembly comprises two coil subassemblies and wherein said housing slidingly receives said two subassemblies within it.

15. The invention of claim 4 wherein said permanent magnet member is a flat magnetic plate, said means for eliminating said air gap including (i) a plurality of protrusions extending from one surface of said magnetic plate, said protrusions being deformable during assembly of the coil assembly within said core member, and (ii) said base end of said T-shaped core member and said other of said two opposed portions of said box-shaped core member each including a tapered mutually engaging interface.

* * * * *